US008657607B2

(12) United States Patent
Xie et al.

(10) Patent No.: US 8,657,607 B2
(45) Date of Patent: Feb. 25, 2014

(54) SOCKET CONNECTOR

(75) Inventors: Bao-Geng Xie, New Taipei (TW); Wei-Hong Liao, New Taipei (TW); Ming-Chiang Chen, New Taipei (TW)

(73) Assignee: Cheng Uei Precision Industry Co., Ltd., New Taipei (TW)

( * ) Notice: Subject to any disclaimer, the term of this patent is extended or adjusted under 35 U.S.C. 154(b) by 167 days.

(21) Appl. No.: 13/314,169

(22) Filed: Dec. 7, 2011

(65) Prior Publication Data

US 2013/0149875 A1 Jun. 13, 2013

(51) Int. Cl.
*H01R 11/30* (2006.01)

(52) U.S. Cl.
USPC ..... 439/38

(58) Field of Classification Search
USPC ..... 439/38–39, 289, 389, 25
See application file for complete search history.

(56) References Cited

U.S. PATENT DOCUMENTS 5,865,648 A * 2/1999 Clyatt, III ..... 439/620.09
6,203,335 B1 * 3/2001 Chang ..... 439/79
7,258,579 B2 * 8/2007 Nam ..... 439/668
7,261,579 B2 * 8/2007 Ku et al. ..... 439/289
7,497,693 B1 * 3/2009 Wu ..... 439/39
7,497,733 B1 * 3/2009 Van der Steen ..... 439/607.01
7,566,224 B2 * 7/2009 Wu ..... 439/39
7,891,991 B2 * 2/2011 Zhang ..... 439/79
8,047,857 B1 * 11/2011 Lu et al. ..... 439/83
8,123,551 B1 * 2/2012 Liu et al. ..... 439/500
8,303,353 B2 * 11/2012 Zhu ..... 439/862
8,460,007 B1 * 6/2013 Xie et al. ..... 439/39

* cited by examiner

*Primary Examiner* — Jean F Duverne

(57) ABSTRACT

A socket connector includes an insulating body having a base portion and a holding portion extending upward from a front of the base portion. The holding portion defines a terminal fillister spread to the base portion. A plurality of openings is opened in a front face of the holding portion and communicates with the terminal fillister. A terminal group is molded in the terminal fillister of the insulating body. The terminal group has a plurality of elastic touching arms stretching outside the insulating body, and a plurality of contact slices exposed through the openings respectively. A magnetic body is curved from a magnetic metal board and defines a window. The magnetic body is mounted around the holding portion with the window facing the openings of the insulating housing to further expose the contact slices therethrough. The terminal group further electrically contacts with the magnetic body.

9 Claims, 4 Drawing Sheets

SOCKET CONNECTOR

BACKGROUND OF THE INVENTION

1. Field of the Invention

The present invention relates to a socket connector, and more particularly to a socket connector adapted for connecting with a plug connector by virtue of magnetic attraction.

2. The Related Art

Nowadays, with the development of electronic technology, electronic products and peripheral devices thereof are connected with each other more and more frequently. And it is a kind of common connection way to realize an electrical connection between the electronic product and its peripheral device by virtue of a connector assembly. The connector assembly includes a socket connector and a plug connector located in the electronic product and its peripheral device respectively, and mated with each other by some means such as magnetic attraction. In detail, the socket connector and the plug connector are provided with magnet blocks therein so as to make the socket connector and the plug connector steadily attract with each other. However, the magnet blocks are often made of metal powder that needs a complicated manufacturing procedure and an expensive cost of manufacture. Moreover, the magnet blocks are fastened in the socket connector generally by glue, so that further increases manufacture cost of the socket connector.

SUMMARY OF THE INVENTION

Accordingly, an object of the present invention is to provide a socket connector. The socket connector includes an insulating body having a base portion and a holding portion extending upward from a front of the base portion. The holding portion defines a terminal fillister spread to the base portion. A plurality of openings is opened in a front face of the holding portion and communicates with the terminal fillister. A terminal group is molded in the terminal fillister of the insulating body. The terminal group has a plurality of elastic touching arms stretching outside the insulating body, and a plurality of contact slices exposed through the openings respectively. A magnetic body is curved from a magnetic metal board and defines a window. The magnetic body is mounted around the holding portion with the window facing the openings of the insulating housing to further expose the contact slices therethrough. The terminal group further electrically contacts with the magnetic body.

As described above, the socket connector molds the terminal group in the terminal fillister of the insulating body, and the magnetic body is curved from a magnetic metal board and mounted around the holding portion of the insulating body. So, the socket connector has a simple manufacturing procedure and a low manufacture cost.

BRIEF DESCRIPTION OF THE DRAWINGS

The present invention will be apparent to those skilled in the art by reading the following description thereof, with reference to the attached drawings, in which.

DETAILED DESCRIPTION OF THE EMBODIMENT

Figure 1:
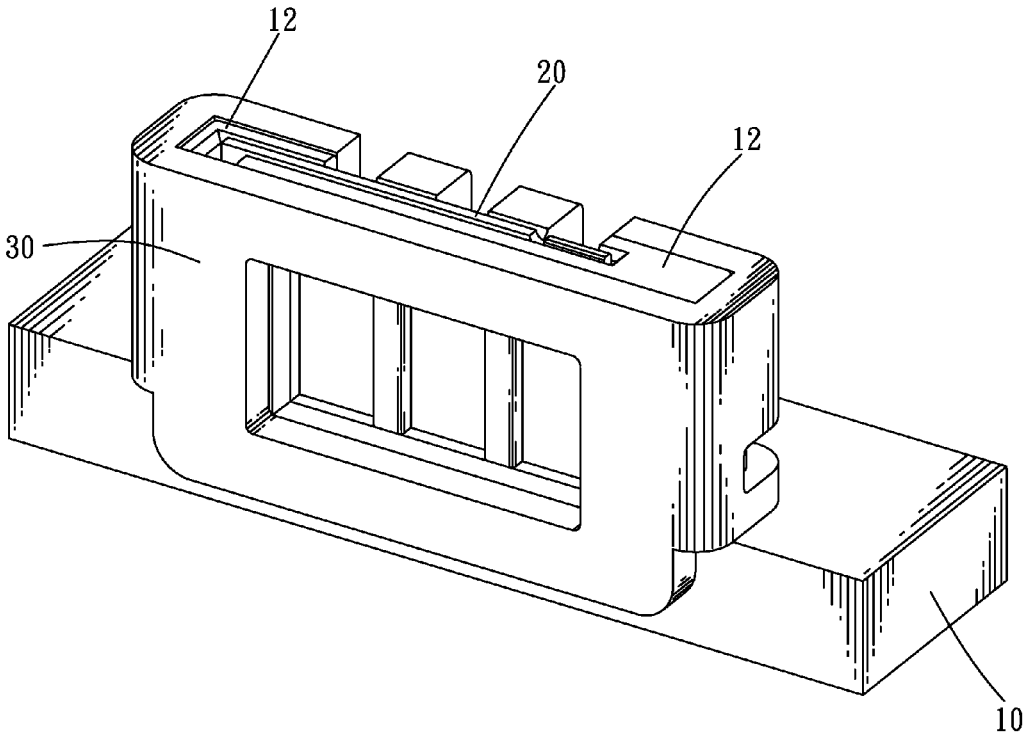
FIG. 1 is an assembled, perspective view of a socket connector in accordance with an embodiment of the present invention.
Figure 2:
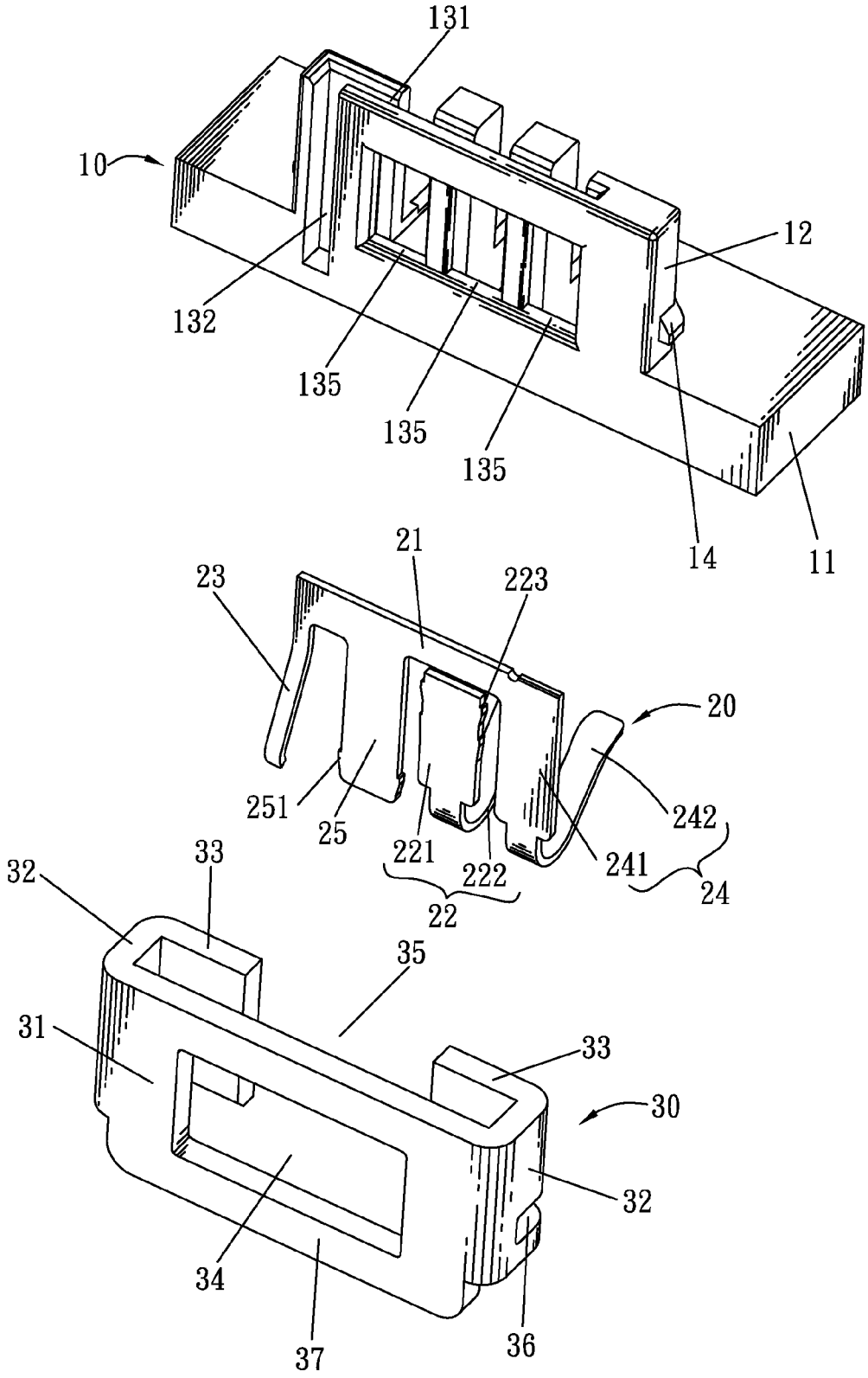
FIG. 2 and FIG. 3 are exploded, perspective views of the socket connector show in FIG. 1.

Referring to FIGS. 1-2, a socket connector according to an embodiment of the present invention includes an insulating body 10, a terminal group 20 molding in the insulating body 10, and a magnetic body 30 mounted to the insulating body 10.

Figure 3:
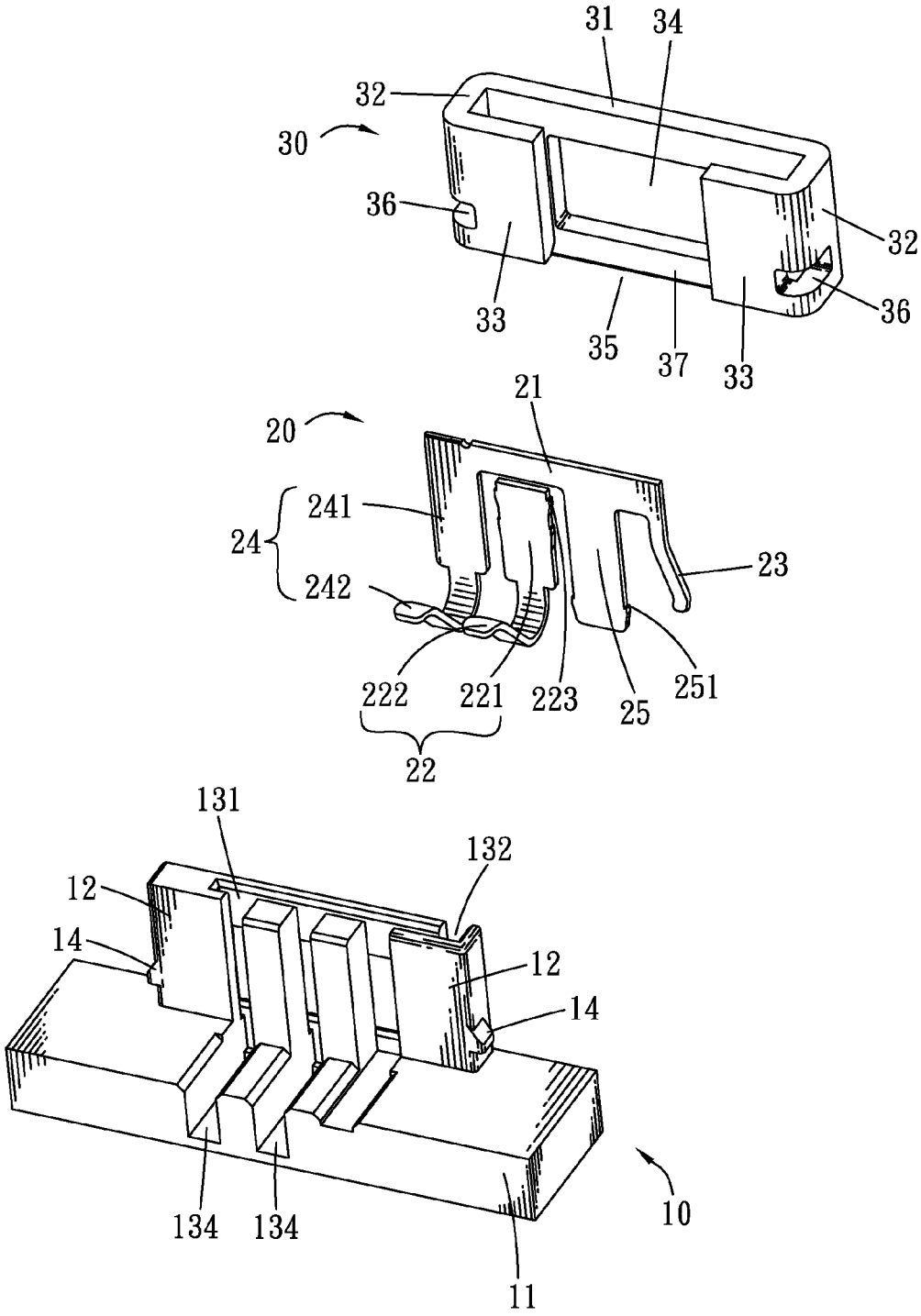
Figure 4:
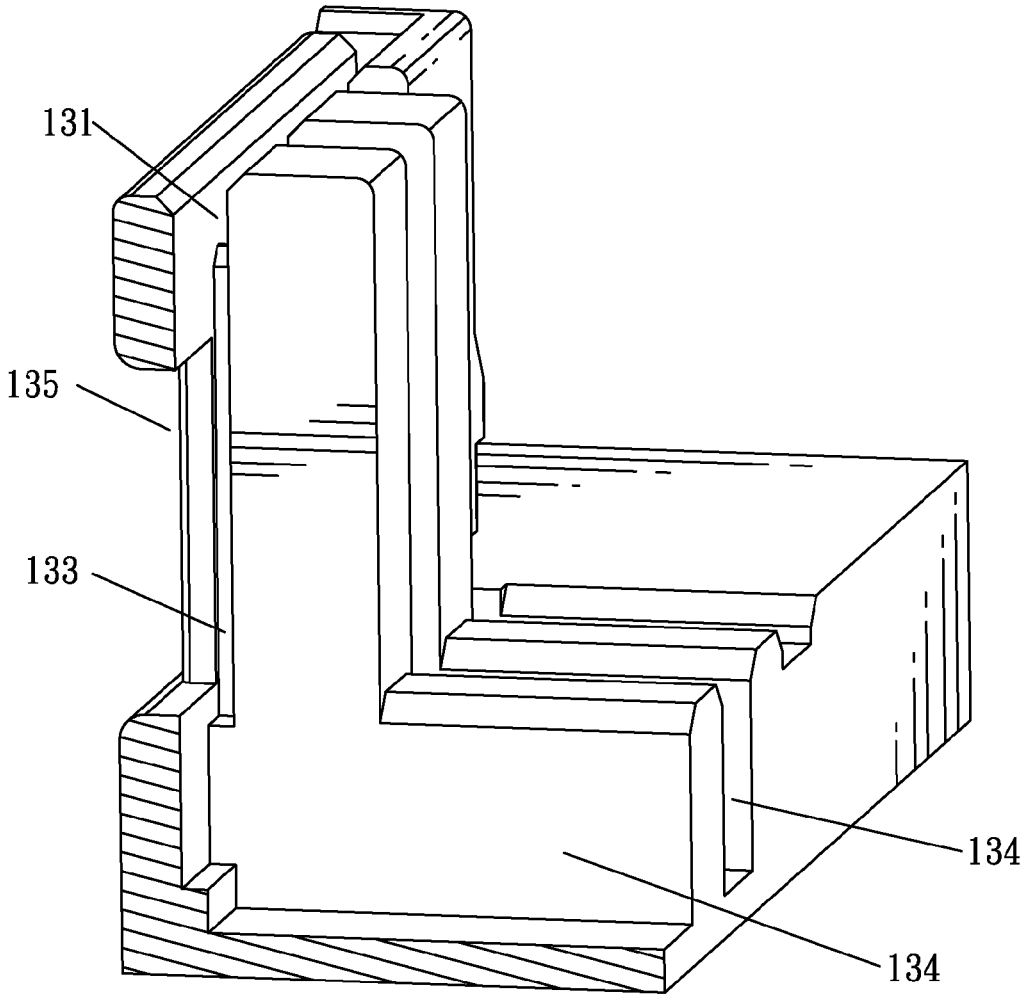
FIG. 4 is a sectional, perspective view of an insulating body of the socket connector show in FIG. 1.

With reference to FIGS. 2-4, the insulating body 10 includes a base portion 11, and a holding portion 12 extending upward from a front of the base portion 11. The holding portion 12 defines a terminal fillister (not labeled) spread to the base portion 11. A plurality of openings 135 is opened in a front face of the holding portion 12 and communicates with the terminal fillister. The terminal fillister includes an inserting slot 131 opened in a top of the holding portion 12, a receiving fillister 132 extending downward from one end of a bottom side of the inserting slot 131 and penetrating through the front face of the holding portion 12, a plurality of fastening slots 133 apart concaved downward from the bottom side of the inserting slot 131 and correspondingly opened behind the openings 135 to further connect with the corresponding openings 135, and a plurality of receiving passages 134 opened in a rear of the base portion 11 and each extending along a front-to-rear direction to connect with a bottom of the corresponding fastening slot 133. The receiving passages 134 further penetrate through a top side of the base portion 11. A pair of locking blocks 14 oppositely protrudes on the opposite sides of the holding portion 12.

Referring to FIGS. 2-3, the terminal group 20 includes a ground terminal 23 and a power terminal 24 formed at two ends of a bottom edge of a base strip 21. The ground terminal 23 extends downward from one end of the bottom edge of the base strip 21 and is inclined forward in process of extending downward. The power terminal 24 has a contact slice 241 extending downward from the other end of the bottom edge of the base strip 21, and an elastic touching arm 242 bending rearward and inclining upward from a bottom end of the contact slice 241. The terminal group 20 further includes a fixing terminal 25 of a rectangular slice shape extending downward from the bottom edge of the base strip 21 and located between the ground terminal 23 and the contact slice 241 of the power terminal 24. The terminal group 20 further includes a signal terminal 22 independent of the ground terminal 23, the power terminal 24 and the fixing terminal 25. The signal terminal 22 has a structure similar to that of the power terminal 24, and has a contact slice 221 and an elastic touching arm 222.

Referring to FIGS. 1-4, the base strip 21 of the terminal group 20 is clipped in the inserting slot 131 of the insulating body 10. The contact slices 241, 221 and the fixing terminal 25 are inserted downward in the fastening slots 133 and further exposed through the corresponding openings 135, and the elastic touching arms 242, 222 elastically project upward out of the corresponding receiving passages 134 behind the holding portion 12, wherein the signal terminal 22 is located between the power terminal 24 and the fixing terminal 25. The ground terminal 23 elastically projects forward out of the receiving fillister 132. Two opposite side edges of the contact slice 221 of the signal terminal 22 protrude outward to form a plurality of fastening hooks 223 stabbed in inner sides of the corresponding fastening slot 133 for securing the signal terminal 22 in the insulating body 10 firmly. Two opposite side edges of the fixing terminal 25 protrude outward to form a plurality of fixing hooks 251 stabbed in inner sides of the corresponding fastening slot 133 for securing the terminal group 20 in the insulating body 10 firmly.

Referring to FIGS. 1-3, the magnetic body 30 is curved from a magnetic metal board and is mounted around the holding portion 12 of the insulating body 10. The magnetic body 30 has a front board 31 covered on the front face of the holding portion 12. Two opposite sides of the front board 31 bend rearward to form two side boards 32 secured to two opposite sides of the holding portion 12. Rear edges of the side boards 32 extend towards each other to form two blocking boards 33 resisting against a back face of the holding portion 12. A bottom of the front board 31 of the magnetic body 30 extends downward to form a strengthening board 37 abutting against a front side of the base portion 11 of the insulating body 10. The front board 31 defines a window 34 opened in a substantial middle thereof and facing the openings 135 of the insulating body 10 for further exposing the contact slices 221, 241 of the signal terminal 22 and the power terminal 24 therethrough. The side board 32 of the magnetic body 30 defines a locking aperture 36 for buckling the locking block 14 of the holding portion 12, so as to ensure a firm assembly of the magnetic body 30 and the insulating body 10. The ground terminal 23 electrically abuts against an inner side of the front board 31 of the magnetic body 30, and could be further pressed into the receiving fillister 132 of the insulating body 10.

As described above, the socket connector molds the terminal group 20 in the terminal fillister of the insulating body 10, and the magnetic body 30 is curved from a magnetic metal board and mounted around the holding portion 12 of the insulating body 10. So, the socket connector has a simple manufacturing procedure and a low manufacture cost.

What is claimed is:

1. A socket connector, comprising:

an insulating body having a base portion and a holding portion extending upward from a front of the base portion, the holding portion defining a terminal fillister spread to the base portion, a plurality of openings being opened in a front face of the holding portion and communicating with the terminal fillister;

a terminal group molding in the terminal fillister of the insulating body, the terminal group having a plurality of elastic touching arms stretching outside the insulating body, and a plurality of contact slices exposed through the openings respectively; and a magnetic body curved from a magnetic metal board and defining a window, the magnetic body being mounted around the holding portion with the window facing the openings of the insulating body to further expose the contact slices therethrough, the terminal group further electrically contacting with the magnetic body;

wherein the magnetic body has a front board covered on the front face of the holding portion of the insulating body, two opposite sides of the front board bend rearward to form two side boards secured to two opposite sides of the holding portion, rear edges of the side boards extend towards each other to form two blocking boards resisting against a back face of the holding portion, and the window is opened in a substantial middle of the front board.

2. The socket connector as claimed in claim 1, wherein the side board of the magnetic body defines a locking aperture, and a pair of locking blocks oppositely protrudes on the opposite sides of the holding portion and is buckled in the locking apertures.

3. The socket connector as claimed in claim 1, wherein a bottom of the front board of the magnetic body extends downward to form a strengthening board abutting against a front side of the base portion of the insulating body.

4. The socket connector as claimed in claim 1, wherein the blocking boards are apart from each other to make a middle of a rear of the holding portion located therebetween, the blocking boards are flush with the back face of the rear middle of the holding portion.

5. The socket connector as claimed in claim 1, wherein the terminal group includes a ground terminal and a power terminal formed at two ends of a bottom edge of a base strip, the ground terminal extends downward from one end of the bottom edge of the base strip and is inclined forward in process of extending downward, the power terminal has the contact slice extending downward from the other end of the bottom edge of the base strip, and the elastic touching arm bending rearward and inclining upward from a bottom end of the contact slice, the terminal group further includes a signal terminal independent of the ground terminal and the power terminal, the signal terminal has a structure similar to that of the power terminal, and has the contact slice and the elastic touching arm, the base strip and the contact slices are embedded in the terminal fillister of the insulating body with the signal terminal located between the ground terminal and the power terminal, the elastic touching arms project beyond a top side of the base portion and behind the holding portion, the ground terminal projects out of the front face of the holding portion to elastically abut against an inner side of the magnetic body.

6. The socket connector as claimed in claim 5, wherein the terminal fillister includes an inserting slot opened in a top of the holding portion for clipping the base strip of the terminal group therein, a receiving fillister extending downward from one end of a bottom side of the inserting slot and penetrating through the front face of the holding portion for receiving the ground terminal therein, a plurality of fastening slots apart concaved downward from the bottom side of the inserting slot and correspondingly opened behind the openings to further connect with the corresponding openings for inserting the contact slices therein, and a plurality of receiving passages opened in a rear of the base portion and each extending along a front-to-rear direction to connect with a bottom of the corresponding fastening slot, the receiving passages further penetrate through the top side of the base portion, the elastic touching arms project upward out of the receiving passages.

7. The socket connector as claimed in claim 6, wherein two opposite side edges of the contact slice of the signal terminal protrude outward to form a plurality of fastening hooks stabbed in inner sides of the corresponding fastening slot.

8. The socket connector as claimed in claim 5, wherein the terminal group further includes a fixing terminal of a rectangular slice shape extending downward from the bottom edge of the base strip, the fixing terminal is embedded in the terminal fillister of the insulating body and located between the ground terminal and the contact slice of the signal terminal, the fixing terminal is further exposed through one of the openings of the holding portion and the window of the magnetic body.

9. The socket connector as claimed in claim 8, wherein two opposite side edges of the fixing terminal protrude outward to form a plurality of fixing hooks stabbed in inner sides of the terminal fillister.

* * * * *